US007554517B2

(12) United States Patent
Baum et al.

(10) Patent No.: US 7,554,517 B2
(45) Date of Patent: Jun. 30, 2009

(54) METHOD AND APPARATUS FOR SETTING GAMMA CORRECTION VOLTAGES FOR LCD SOURCE DRIVERS

(75) Inventors: David R. Baum, Tucson, AZ (US); Frank Haupt, Tucson, AZ (US); Jerry L. Doorenbos, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 778 days.

(21) Appl. No.: 11/079,357

(22) Filed: Mar. 14, 2005

(65) Prior Publication Data

US 2006/0202929 A1 Sep. 14, 2006

(51) Int. Cl.
*G09G 3/36* (2006.01)

(52) U.S. Cl. ..... 345/89; 345/98

(58) Field of Classification Search ..... 345/89, 345/98, 100, 204, 690
See application file for complete search history.

(56) References Cited

U.S. PATENT DOCUMENTS

| | | | | |
|---|---|---|---|---|
| 5,572,211 | A | 11/1996 | Erhart et al. | 341/144 |
| 6,593,934 | B1 * | 7/2003 | Liaw et al. | 345/590 |
| 6,781,532 | B2 * | 8/2004 | Wei | 341/122 |
| 6,784,861 | B2 * | 8/2004 | Okada | 345/87 |
| 6,879,310 | B2 * | 4/2005 | Nose | 345/88 |
| 6,927,712 | B2 * | 8/2005 | Wei | 341/122 |
| 7,006,065 | B1 * | 2/2006 | Sugawara et al. | 345/89 |
| 7,224,351 | B2 * | 5/2007 | Lee | 345/205 |
| 7,233,305 | B1 * | 6/2007 | Orlando et al. | 345/89 |
| 2003/0043168 | A1 * | 3/2003 | Dalal | 345/601 |
| 2003/0085859 | A1 | 5/2003 | Lee | 345/87 |
| 2003/0117362 | A1 * | 6/2003 | An | 345/98 |
| 2004/0125422 | A1 | 7/2004 | Wang et al. | 358/519 |
| 2008/0170027 | A1 * | 7/2008 | Kyeong et al. | 345/100 |

OTHER PUBLICATIONS

BUF 12800 Reference Voltage Generator for LCD Gamma Correction, Burr-Brown Products from Texas Instruments, SBOS315—Dec. 2004, Texas Instruments Incorporated, pp. 1-20.

* cited by examiner

*Primary Examiner*—Ricardo L Osorio
(74) *Attorney, Agent, or Firm*—John J. Patti; Wade J. Brady, III; Frederick J. Telecky, Jr.

(57) ABSTRACT

A gamma reference voltage generator (10B) for an LCD display includes a control interface logic circuit (48) having an output bus coupled to inputs of a first register (46) having outputs coupled to inputs of a second register (42) the outputs of which are coupled to corresponding inputs of plurality of DACs (28). The control interface logic circuit receives gray scale codes representative of gamma reference voltages and transfers the codes via the output bus into the first register and controls further transfer of the codes to inputs of the DACs to instantaneously or rapidly update gamma correction voltages applied to the LCD display.

20 Claims, 6 Drawing Sheets

METHOD AND APPARATUS FOR SETTING GAMMA CORRECTION VOLTAGES FOR LCD SOURCE DRIVERS

BACKGROUND OF THE INVENTION

The present invention relates generally to improved circuits and methods for generating the gamma correction voltages required for achieving satisfactory performance in driving LCD displays (liquid crystal displays), and more particularly to circuits and methods which allow more efficient optimization of gamma correction voltages needed to provide suitable images on the LCD displays. The invention also relates to improved circuits and methods which allow improved dynamic gamma voltage correction.

Color LCD displays are widely used for desktop computers and laptop computers, and consist of LCD pixel elements that are typically controlled by a matrix of intersecting gate drivers (also known as row drivers) and source drivers (also known as column drivers). Referring to "prior art" FIG. 1, the source drivers in source driver switch circuitry 18 are used to control the gray scale of each pixel by converting the digital image data 36 into corresponding voltages produced by means of a resistor-string DAC 23 and multiplexing the appropriate voltages by means of the source driver switch circuitry 18 to appropriate outputs 20-1,2 . . . q coupled to corresponding columns of pixel elements. The transmission characteristic of resistor-string DAC 22 is typically "nonlinear" to compensate for the non-linear transmission characteristic of the LCD display 11. The nonlinear behavior of resistor-string DAC 22 can be thought of as being represented by an "intrinsic" gamma correction curve (sometimes also referred to as a "color curve"). The nonlinear transfer function of each LCD display 11 is unique, and therefore the intrinsic gamma curve built into the source driver circuitry 16 by resistor-string DAC 22 has to be modified to achieve optimum display performance. (See U.S. Pat. No. 5,572,211 entitled "Integrated Circuit for Driving Liquid Crystal Display Using Multi-Level D/A Converter" issued Nov. 5, 1996 to Erhart et al., which is incorporated herein by reference.)

Source driver switch circuitry 18 and "resistor-string" DAC 22 are included in a source driver circuit 16, the outputs of which are produced on conductors 20-1,2 . . . q, where q is the number of columns of pixel elements in LCD display 11. q may be very large, for example 4096, for a very wide LCD screen 11. The resistors 23 in source driver resistor-string DAC 22 are connected in series between a high reference voltage VH and a low reference voltage VL, and the voltages at the junctions between conductors 19-1,2 . . . m define an "intrinsic" gamma curve. (As an example, the number of resistors is m=256 for an 8-bit source driver.) This intrinsic gamma curve is often adjusted for optimal panel performance by means of an external high-precision resistive voltage divider 13 including n precision resistors R1, R2 . . . Rn that also are coupled in series between VH and VL. VH, VL, and the various junctions between precision resistors R1, R2 . . . Rn are coupled either directly to conductors 19-1,2 . . . m, respectively, or are coupled to the inputs of buffers 2-1,2 . . . m as shown in FIG. 1. The outputs of buffers 2-1, 2 . . . m are connected to conductors 19-1,2 . . . m, respectively (where m=n−1). The values of precision resistors R1,2 . . . n usually are painstakingly determined (in the manner subsequently described) in order to optimize the display gamma curve by externally modifying the intrinsic gamma curve established by resistor-string DAC 22 for best display viewing performance. That approach is costly because the required calculations and trial-and-error experimentation required to obtain the resistor values is subjective, difficult, and time-consuming.

Alternatively, changes can be made in the integrated circuit mask used to manufacture source driver circuitry 16 in order to provide precise adjustments to the values of the various resistors 23 so as to obtain the desired gamma curve. However, that approach usually has been found to be too difficult and costly, because it would require adjustment for each LCD panel, as every LCD panel is different, and there are lot-to-lot differences resulting from manufacturing variations.

The "gamma voltage correction" involves correcting the above-mentioned intrinsic gamma curve so as to make the "gray scale" of displayed LCD screen images appear more satisfactorily in the eyes of a trained expert. FIG. 3 shows a typical LCD display intrinsic gamma curve, wherein the gray scale of LCD pixels is plotted versus the digital codes representing the image data applied via conductors 20-1,2 . . . q to pixels in the selected rows of TFT-LCD display panel 11 in FIGS. 1 and 2. The digital codes GMA 1-*m* correspond to the conductors 19-1,2 . . . m in FIG. 1 and represent the gamma correction input voltages provided to source driver circuitry 16. The intrinsic gamma curve is adjusted for better panel performance by "forcing" GMA nodes 19-1,2 . . . m to specific voltage levels.

In the prior art, one technique for generation of an intrinsic gamma curve for a particular LCD screen involves a subjective, time-consuming optimization of the values of precision resistors R1,2 . . . n in an external resistive voltage divider string to produce the correct gamma correction voltages at the various nodes of a resistive voltage divider which constitutes resistor-string DAC 22. The resistor values determined during the optimizing process are utilized to manufacture resistive voltage dividers for the LCD TV displays. The various nodes of the resistive voltage divider typically are connected to corresponding nodes of the resistor-string DAC 22 and to inputs of buffer circuits 2-1,2 . . . m, the outputs of which drive source driver switch circuitry 18 of a conventional TFT-LCD panel (thin-film transistor LCD panel). The gamma correction buffers for TFT-LCD panels must be set to appropriate voltages so that the desired gamma curve is accurately represented by the range of gamma correction voltages produced by the various buffers.

This technique of optimizing values of precision resistors R1,2 . . . n in the resistive voltage divider is very time-consuming, because a person expert in adjusting gamma correction voltages so as to produce images of desirable quality must be involved in the trial-and-error selection of precision resistors utilized in the resistive voltage divider. The procedure can require many hours to determine the values of all of the resistors of the resistive voltage divider. In some cases precision potentiometers can be utilized to optimize the resistors of the voltage divider, but the "programming" nevertheless is very time-consuming. In any case, the optimum values of the resistors R1,2 . . . n of the external resistive voltage divider then must be used in assembling identical resistive voltage dividers in each gamma reference voltage generator to produce the correct gamma correction voltages to be provided as inputs to each of the source driver circuits. This procedure must be repeated for each different kind of TFT-LCD display. The precision resistors are expensive, and the assembly of the resistive voltage divider of optimally selected precision resistors also is expensive.

Present gamma correction schemes like the one shown in prior art FIG. 1 for resistor-string DACs are not inherently limited in the number of "DAC channels", i.e., channels of gamma reference voltage correction. For example, there are LCD displays presently available that use up to 22 channels of gamma reference voltage correction. However the higher the number of channels of gamma reference voltage correction, the more difficult and time consuming the optimization process becomes.

Furthermore, the above described prior "manual" programming technique cannot be used if "dynamic gamma voltage correction" is desired to provide dynamic or real-time improvement of picture quality in LCD panels or to adjust for variations in temperature or ambient light conditions. A single DAC having an output multiplexed to multiple sample-hold circuits which store the needed gamma correction voltages has been used in conjunction with dynamic gamma correction, wherein the sample-hold circuits repetitively refreshed during the raster scanning process.

FIG. 2 shows a TFT-LCD display system 1B in which TFT-LCD display panel 11, gate driver circuitry 12, controller circuitry 32, and source driver circuitry 16 are generally the same as in FIG. 1. However, the inputs of buffers 2-1,2 . . . m are connected to the outputs of m corresponding sample/hold circuits 5-1,2 . . . m as shown, instead of being connected to the various junctions of an external resistive voltage divider 13 as shown in FIG. 1. The inputs of the various sample/hold circuits 5-1,2 . . . m are coupled by corresponding conductors 9-1,2 . . . m, respectively, to the outputs of a single multiplexer 6. The output of a single DAC 7 is connected to the input of multiplexer 6. The digital input of DAC 7 is generated by a control interface logic circuit 8, the output of which is controlled in response to signals 34 produced by controller circuitry 32, wherein controller 32 retrieves the stored data from an EEPROM 26 for one or multiple gamma curves and accordingly updates DAC registers (not shown) that are included in control interface logic 8.

Thus, a single DAC 7 combined with a multiplexer and multiple sample/hold circuits 5-1,2 . . . m have been used to provide the required gamma correction voltages. The circuitry including control interface logic 8, DAC 7, multiplexer 6, and sample/hold circuits 5 is well known, as it is used in various TFT-LCD reference voltage generator products produced under the trademark ELANTEC by Intersil America, Inc.

To determine the values of the digital DAC inputs in FIG. 2 which represent an optimized initial static gamma curve, the values of the digital inputs to the DAC could be adjusted under the control of an expert who is highly skilled in visualizing and correcting displays on LCD screens. The expert could adjust the DAC output values so as to adjust the gamma voltages to values that produce a gray scale that is satisfactory to the expert. Those digital input values to the DAC then could be stored in a suitable non-volatile memory, such as EEPROM 26.

However, it is believed that no one has yet been successful in fully or substantially automating the initial generation of the static gamma curve in an LCD display system. (Usually, such generation of the static gamma curve is performed only once or twice during the life of an LCD display.)

Thus, there is an unmet need for a system and method which avoids the need for repetitively refreshing the sample-hold circuits used in some prior art gamma correction voltage systems.

There also is an unmet need for a system and method that both allows fast programming and fast updating of all "gamma channels" for dynamic gamma control in an LCD display system.

There also is an unmet need for a system and method which avoids costs of maintaining an inventory of precision resistors for resistive voltage dividers required in some prior art gamma correction voltage systems.

There also is an unmet need for a system and method for more effectively and more rapidly accomplishing dynamic gamma voltage correction of a TFT-LCD display panel.

There also is an unmet need for an economical way of providing a larger number of accurate gamma voltages to more accurately represent color curves for TFT-LCD display panels.

There also is an unmet need for a gamma reference voltage generating system which will make it more practical to automate the initial generation of the static gamma curve in an LCD display system.

SUMMARY OF THE INVENTION

It is an object of the invention to provide a system and method which avoids the need for repetitively refreshing the sample-hold circuits used in some prior art LCD display gamma correction voltage systems.

It is another object of the invention to provide a system and method which avoids costs of maintaining an inventory of precision resistors for resistive voltage dividers required in some prior art LCD display gamma correction voltage systems.

It is another object of the invention to provide an LCD display gamma correction system and method which avoids "artifacts" in the displayed image due to relatively slow sequential updating of the screen image.

It is another object of the invention to provide a system and method for more effectively and more rapidly accomplishing dynamic gamma voltage correction of a TFT-LCD display panel.

It is another object of the invention to provide an economical way of providing a larger number of accurate gamma voltages to more accurately represent gamma curves for TFT-LCD display panels.

It is another object of the invention to provide a faster and/or more economical way to adjust the static gamma curve for an LCD display.

It is another object of the invention to provide a gamma reference voltage generating system which will make it more practical to automate the initial generation of the static gamma curve for an LCD display system.

It is another object of the invention to provide faster updating for dynamic gamma voltage correction of TFT-LCD displays of very large physical size and/or very high image resolution.

Briefly described, and in accordance with one embodiment, the present invention provides a gamma reference voltage generator (10A or 10B) for generating and applying gamma reference voltages to a source driver circuit (16) of an LCD display system in response to gray scale codes received from a controller (32A or 32B). One embodiment includes a control interface logic circuit (30 or 48) having an output bus (52), a first register (46) including a plurality of groups of storage cells (46), the storage cells of each group having an input coupled to corresponding conductors of the output bus (52), a plurality of DACs (28) each having an input coupled to an output of a corresponding storage cell of the first register (46). The control interface logic circuit (48) operates to receive gray scale codes representative of gamma reference voltages to be applied to source drivers (66) of the source driver circuit (16) and transfer the gray scale codes via the output bus (52) to corresponding storage cells of the first register (46) and to cause the gray scale codes in the first register (46) to be coupled to inputs of the DACs (28-1,2 . . .

m) to produce signals representative of the gamma correction voltages to be applied to the source driver circuit (16). Another embodiment of the invention further includes a second register (42) including a plurality of storage cells each having an input coupled to an output of the corresponding storage cell of the first register (46), the control interface logic circuit (48) causing the gray scale codes in the first register (46) to be applied to the inputs of the DACs (28) by entering the gray scale codes in the first register (46) into the second register (42).

In the described embodiments, the source driver circuit (16) includes a resistor-string DAC (22) including a plurality of resistors (23) coupled in series between first (VH) and second (VL) reference voltages, a plurality of switches (60) being coupled between various junctions between the resistors (23) and an input of a multiplexer (64), outputs of the multiplexer (64) being coupled to column driver buffers (66) of the source driver circuit (16), various groups of the resistors (23) being coupled between outputs of various pairs of the buffers (24-1,2 . . . m), respectively. A serial bus (SCK, SDA) couples gray scale codes from the controller (32B) to the control interface logic (48). In a described embodiment, storage cells of the first register (46) include flip-flops and the storage cells of the second register (42) include latches. Switch control logic (65) is coupled to control the switches (60) to sequentially couple gamma correction voltages from the resistor-string DAC (22) to the input of the multiplexer (64) in response to a control signal (36) from the controller (32B).

The first control signal (EN) can be set to a "1" level to cause the latches (42-1,2 . . . m) to be transparent thereby causing inputs to the DACs (58-1,2 . . . m) to be immediately updated with gray scale codes as they are loaded into the flip-flops (46-1,2 . . . m) by the control interface logic circuit (48).

The first (EN) and second (LOAD) control signals can be set to "0" levels to cause the latches (42-1, 2 . . . m) and the DACs (28-1, 2 . . . m) to maintain previous gamma reference voltages during transfer of gray scale codes by the control interface logic circuit (48) into the flip-flops (46-1, 2 . . . m), and the first control signal (EN) then is set to a "1" level to simultaneously update the contents of the latches (42-1, 2 . . . m) and thereby simultaneously update output voltages of the DACs (28-1,2 . . . m), to thereby avoid image artifacts associated with sequential updating of columns of an image being displayed by the LCD display system.

The control interface logic circuit (48) can be operated to maintain the second control signal (LOAD) at a "1" level while updating gray scale codes in the flip-flops (46-1,2 . . . m) to maintain the outputs of the DACs (28-1,2 . . . m) unchanged while updating the flip-flops (46-1,2 . . . m) and then set the second control signal (LOAD) to a "0" level to set the latches (42-1,2 . . . m) to a transparent condition to cause the DACs (28-1,2 . . . m) to be simultaneously updated with the gray scale codes updated in the flip-flops (46-1,2 . . . m), to thereby avoid image artifacts associated with sequential updating of columns of an image being displayed by the LCD display system.

In one embodiment of the invention, loading of various gray scale codes into the first register (46) is performed in response to observation of visual effects of various gray scale codes on one or more images displayed by the LCD display system to obtain an optimized color curve for the LCD display system. Gray scale codes representing the optimized color curve then are stored in a non-volatile memory accessible by the controller (32B).

DETAILED DESCRIPTION OF THE PREFERRED EMBODIMENTS

Figure 4:
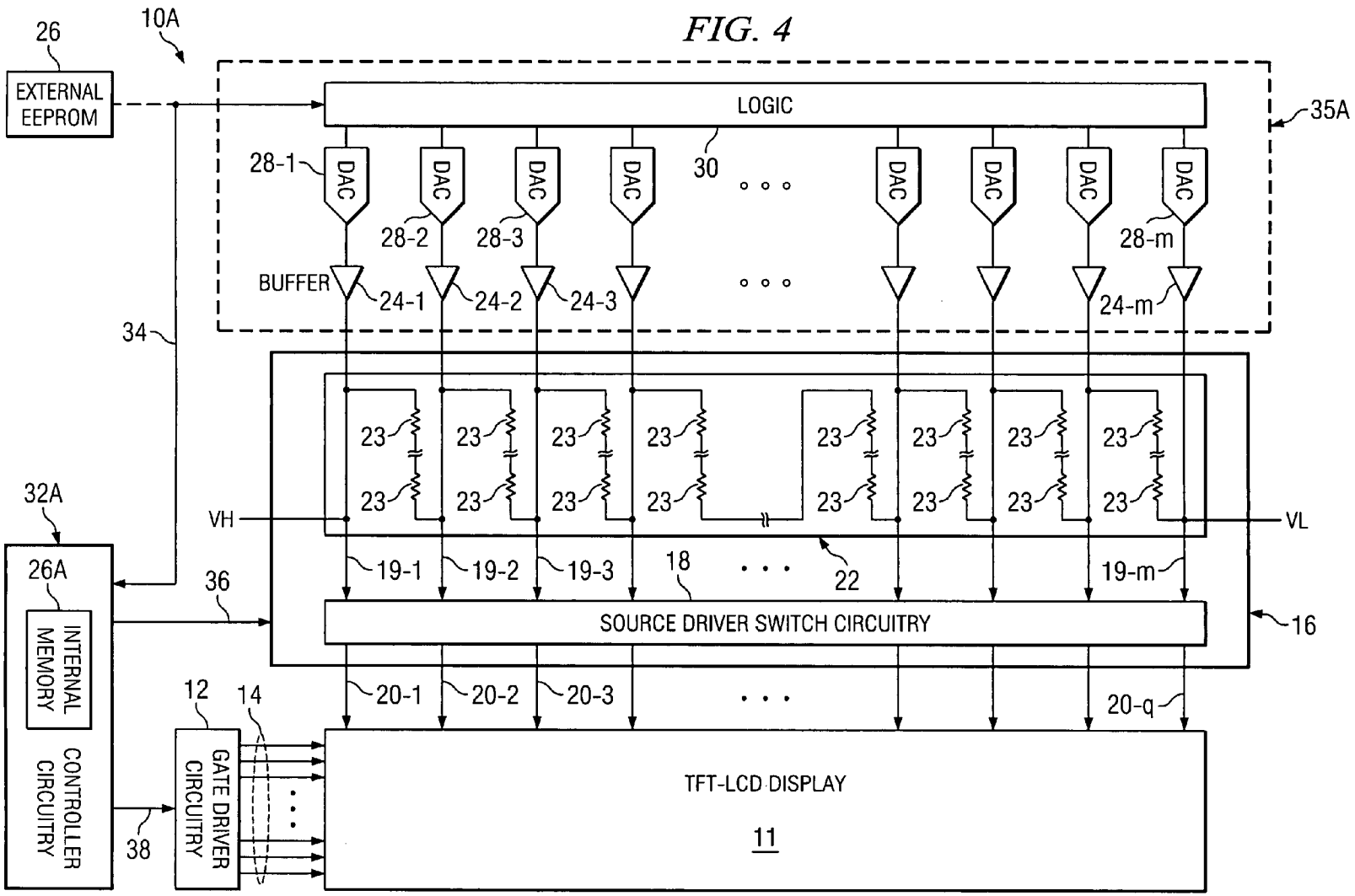
FIG. 4 is a block diagram of a LCD display system according to the present invention.

Referring to FIG. 4, TFT-LCD display system 10A includes a TFT-LCD display panel 11 having many rows (depending on the height of LCD display panel 11) of LCD pixels selectable by lines 14 that are driven by gate driver circuitry 12 in response to signals sent by controller circuitry 32A via conductor or bus 38. LCD display panel 11 includes many columns (e.g., as many as 4096 columns or even more depending on the width of the LCD display panel 11) of LCD pixels coupled, respectively, to gamma reference voltage signals produced on conductors 20-1,2 . . . q by a source driver circuit 16, where q is the number of columns of pixels. Source driver switch circuitry 18 produces intensity or brightness control signals on conductors 20-1,2 . . . q for controlling the gray scale (i.e., the brightness or intensity of the LCD pixels in each column at its intersections with the selected rows).

Figure 1:
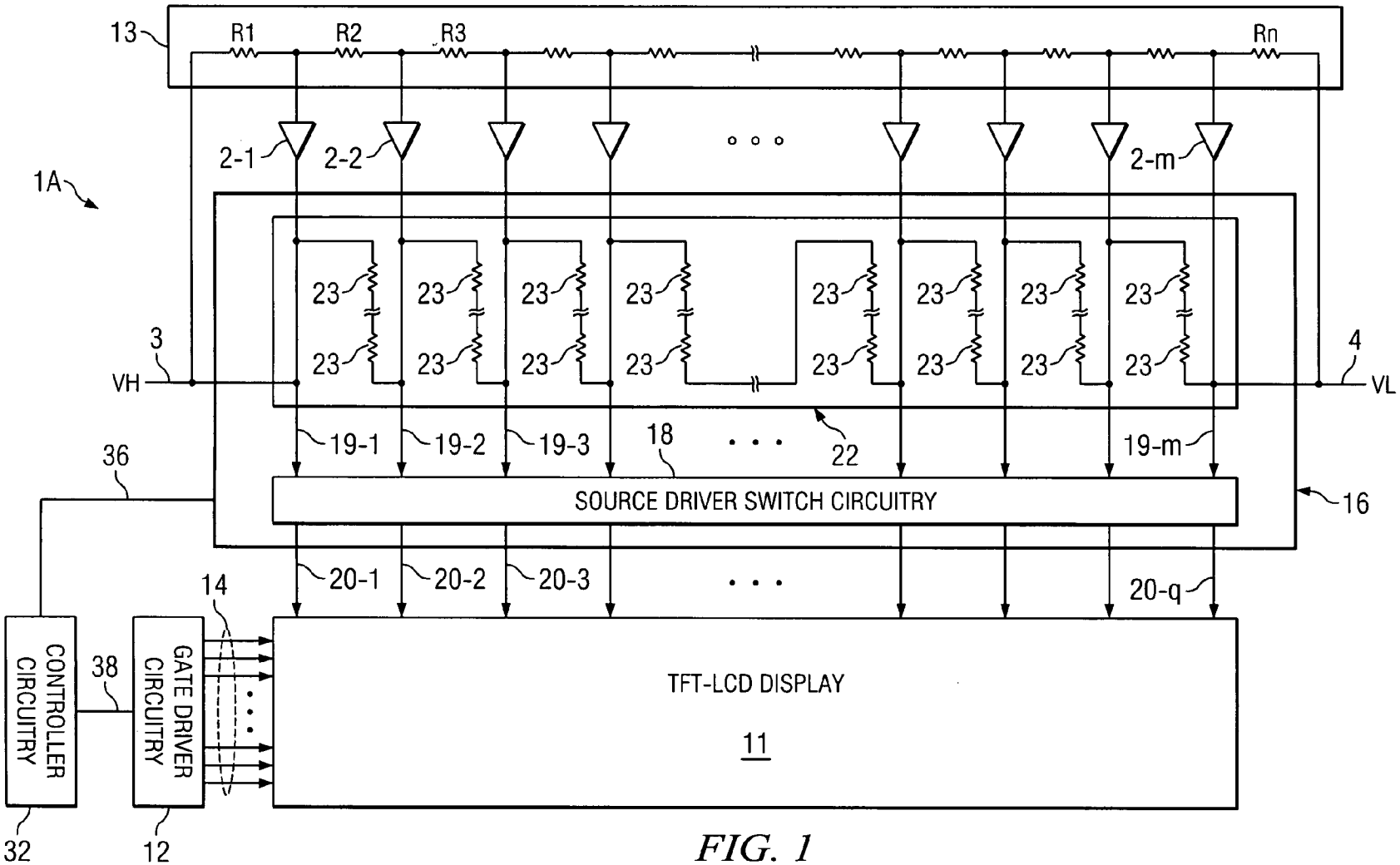
FIG. 1 (PRIOR ART)
FIG. 1 is a block diagram of a prior art LCD display system.

As in prior art FIG. 1, the source drivers in source driver switch circuitry 18 are used to control the gray scale of each pixel by converting the digital image data 36 into corresponding voltages produced by means of the resistor-string DAC 23 and multiplexing the appropriate voltages by means of the source driver switch circuitry 18 to the appropriate outputs 20-1,2 . . . q to corresponding columns of pixel elements. The gray scale transmission characteristic of resistor-string DAC 22 is typically "nonlinear" to compensate for the non-linear transmission characteristic of the LCD display 11. The nonlinear behavior of the resistor-string DAC 22 can be thought of as being represented by an "intrinsic" gamma correction curve (sometimes also referred to as a "color curve"). The nonlinear transfer function of each LCD display 11 is unique, and therefore the intrinsic gamma curve built into the source driver circuitry 16 by resistor-string DAC 22 ordinarily must be modified to achieve optimum display performance of a particular LCD display screen.

As in prior art FIG. 1, source driver switch circuitry 18 and resistor-string DAC 22 in FIG. 4 are included in a source driver circuit 16, the outputs of which are produced on conductors 20-1,2 . . . q, where q is the number of columns of pixel elements in LCD display 11. q may be very large, for example 4096, for a very wide LCD screen 11. (Details of resistor-string DAC 22 are shown in subsequently described FIG. 8. The string DAC resistors 23 are connected in series between a high reference voltage VH and a low reference voltage VL, and the voltages at the junctions between conductors 19-1,2 . . . m generally define an "intrinsic" gamma curve. (As an example, the number of resistors is m=256 for an 8-bit source driver.)

In FIG. 4, a gamma reference voltage generator circuit 35A includes logic circuitry 30, DACs 28-1,2 . . . m and a buffers 24-1,2 . . . m. (Buffers 24-1,2 . . . m could, of course be included within DACs 28-1,2 . . . m.) Gamma reference voltage generator 35A is coupled by a conventional I2C bus 34 including a SDA conductor and a SCL conductor to controller 32A. Outputs of logic circuit 30 are connected to the inputs of DACs 28-1,2 . . . m, the outputs of which are connected to inputs of corresponding buffers 24-1,2 . . . m, respectively. The outputs of buffers 24-1,2 . . . m are connected to conductors 19-1,2 . . . m, respectively, which may be but are not necessarily directly connected to the q inputs of source driver switch circuitry 18. The output voltage values of buffers 24-1,2 . . . m are determined by the reference voltages VH and VL and by the decimal value of the binary input code used to "program" that buffer.

Logic circuit 30 operates in response to data and clock signals received on 12C bus 34 from controller 32A and performs the function of assembling the digital inputs for DACs 28-1, 2 . . . m so as to produce desired gray scale or intensity of pixels in the row currently selected by gate drive circuitry 12 in response to digital gray scale codes received from either an internal non-volatile memory 26A of the controller 32A or from an external EEPROM 26 and converted to the digital signals that are applied to the inputs of the various DACs.

Figure 2:
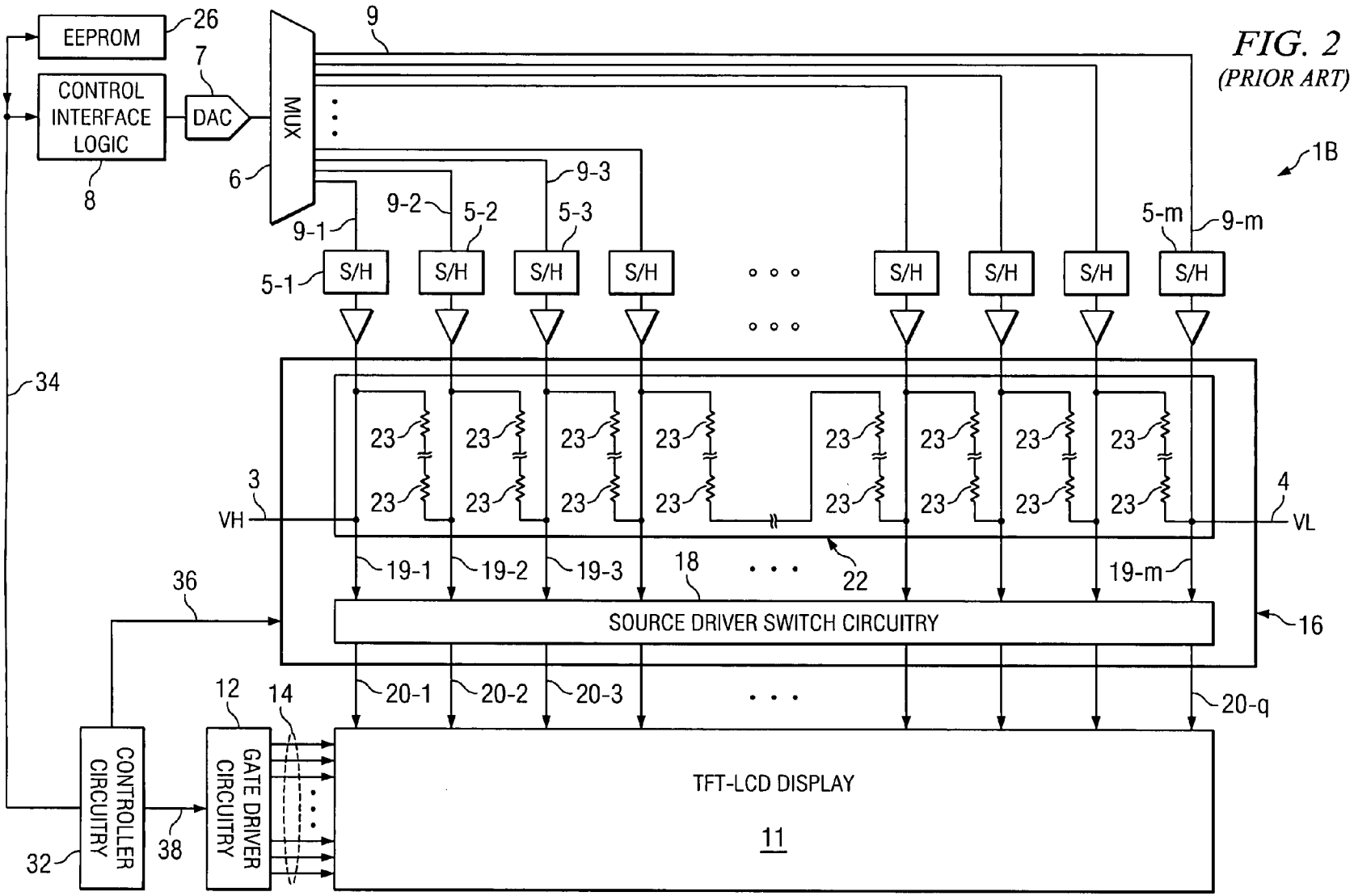
FIG. 2 (PRIOR ART)
FIG. 2 is a block diagram of another prior art LCD display system.
Figure 3:
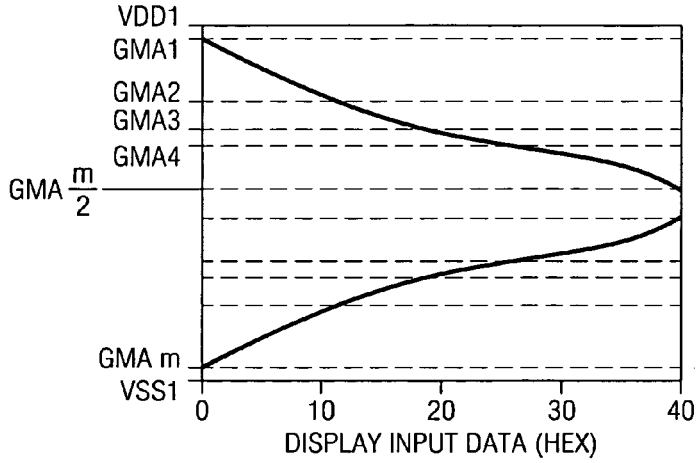
FIG. 3 is a graph of the "intrinsic" gamma curve for a conventional TFT-LCD display system.

Controller 32A of FIG. 4 can be essentially the same as controller 32 of prior art FIG. 2, although non-volatile memory 26A can be included within controller 32A, which avoids the delay required for fetching the gamma correction data from an external memory such as external EE prom 26.

Figure 5:
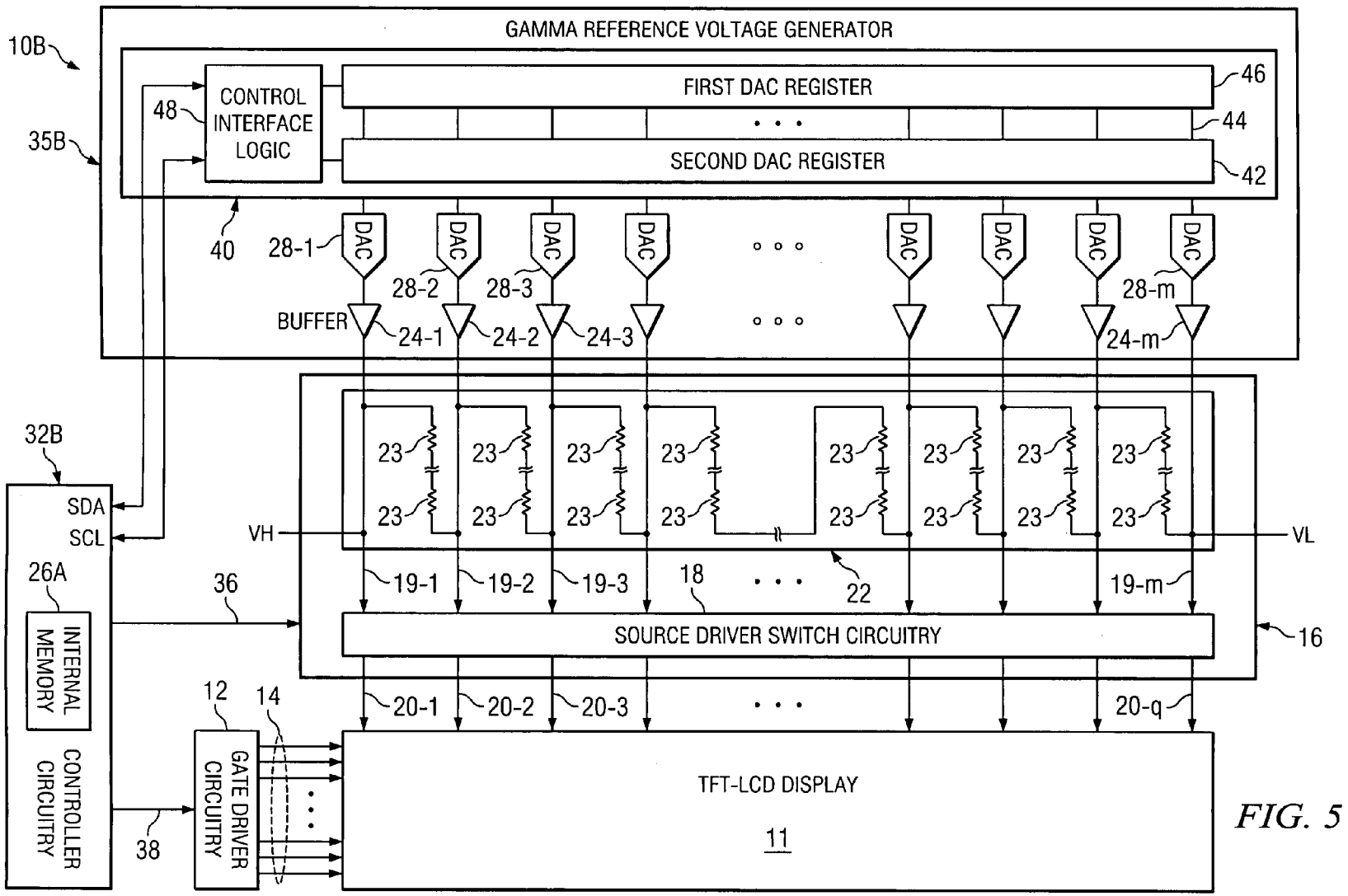
FIG. 5 is a block diagram of another LCD display system according to the present invention.

Referring to FIG. 5, a preferred embodiment of LCD display system 10B is similar to the assignee's "Reference Voltage Generator for LCD Gamma Correction" described in its data sheet "SBOS315-December 2004", posted on the assignee's web site (www.ti.com). Referring to FIG. 5, source driver circuit 16, gate driver circuit 12, and controller 32B of TFT-LCD display system 10B are generally similar to the corresponding circuits in FIG. 4. However, gamma reference voltage generator 35B in FIG. 5 includes I2C control interface logic 48, first DAC register 46 (hereinafter referred to as "register 46"), and second DAC register 42 (hereinafter referred to as "register 42") which operates so as to produce the digital inputs for DACs 28-1 . . . m. Gamma reference voltage generator 35B is coupled to controller 32B by I2C bus SDA,SCL. As an example, DACs 28 can be 10-bit R2R DACs, although various other kinds of DACs also could be used. (It should be understood that gamma correction system circuitry including DACs 28-1,2 . . . m completely overrides, i.e., over-powers, the intrinsic gamma curve generated by the built-in string DAC 22. For example, if all of the outputs of buffers 24 are at "0" levels, nothing will appear on the LCD screen because the built-in string DAC output signals are completely overpowered by the outputs of buffers 24.)

The I2C bus (or any other serial bus) cannot update many registers simultaneously. In order to simultaneously transfer the contents register sections 42-1,2 . . . m to the inputs of DACs 28-1,2 . . . m, a second level of register sections 42-1,2 . . . m is provided that directly controls the digital inputs of DACs 42, wherein the first level of registers 46 holds new digital gray scale codes.

The inputs of register sections 46-1,2 . . . m are connected to conventional I2C interface circuitry included in 12C control interface logic 48, so updated digital data initially entered into register 46 can be held long enough to allow use of several different ways of simultaneously updating or sequencing the updating of the gray scale information to each of the q columns of LCD display panel 11.

Figure 7:
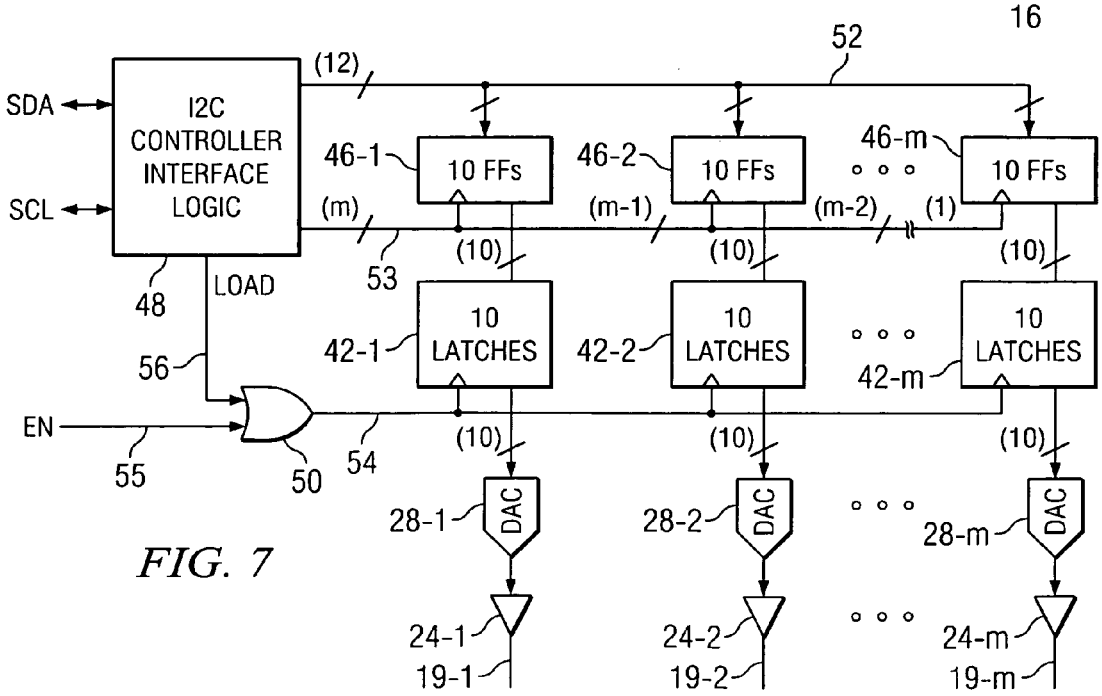
FIG. 7 is a detailed block diagram of the circuitry in block 16 of FIG. 5.

FIG. 7 shows an example in which m=12, wherein a 12 bit bus 52 is coupled from I2C control interface logic 48 to the inputs of each of 10 flip-flops of m register sections 46-1,2 . . . m. A second bus 53 has m conductors, one connected to the clock input of each of the 10 flip-flops of a corresponding register section 46-1,2 . . . m, respectively. The outputs of each of the 10 flip-flops in each of register sections 46-1,2 . . . m are connected to inputs of 10 corresponding latches in each of register sections 42-1,2 . . . m, respectively.

A signal LOAD produced by I2C control interface logic 48 on conductor 56 is connected to one input of an OR gate 50. The other input of OR gate 50 is connected by conductor 55 to receive an enable signal EN. The outputs of the 10 latches included in register section 42-1 are connected, respectively, to the corresponding digital inputs of DAC 28-1. Similarly, the outputs of the 10 latches included in register section 42-2 are connected, respectively, to the corresponding digital inputs of DAC 28-2, and so forth. (Those skilled in the art will recognize that OR gate 50 is intended to represent any logic gate, such as a NOR gate with "active high" inputs or an AND gate or NAND gate with "active low" inputs, that performs a logical ORing function.)

The digital inputs being applied to the flip-flops in each register section 46-1,2 . . . m are clocked into that register section in response to a rising edge of a signal applied to its clock input via one of the m conductors of bus 53. The latches in register sections 42-1,2 . . . m are "transparent" if the signal on conductor 54, i.e., the clock input of the latches, is at a "1" level. That is, any digital signal on the inputs of the latches 42-1, 2 . . . m is immediately passed through to the outputs of the latches 42-1, 2 . . . m and hence to the inputs of DACs 28. However, if the signal on conductor 54 is at a "0" level, then the latches 42-1, 2 . . . m continue to hold their previous logic levels.

Figure 8:
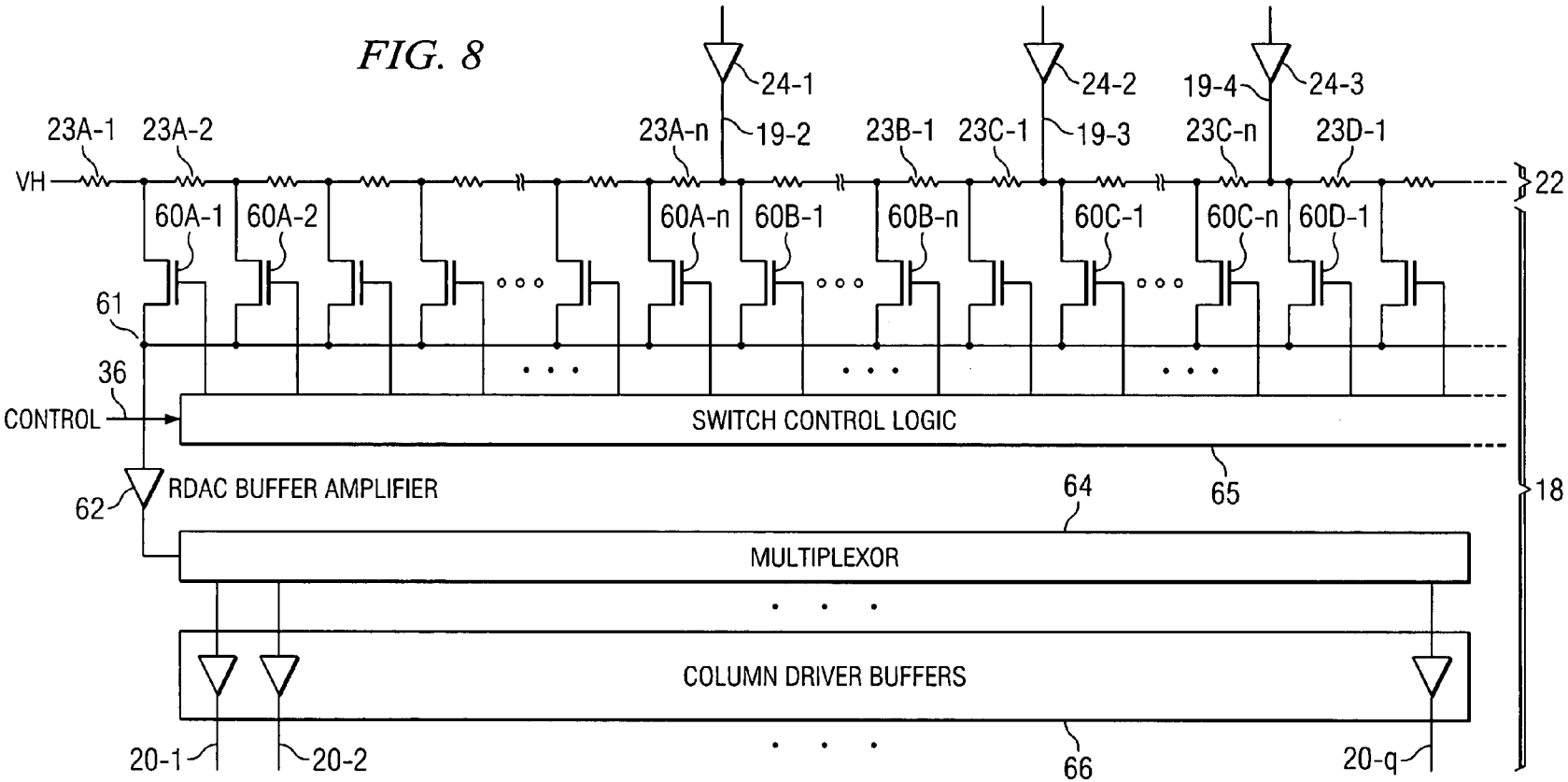
FIG. 8 is a diagram illustrating details of three DAC channels of resistor-string DAC 22 and details of source column driver circuitry 18 in FIG. 5.

FIG. 8 shows an example of an expanded view of three "DAC channels" of gamma voltage reference generator 35B, including 10-bit DAC's 28-1,2 . . . m and corresponding sections of registers 46 and 42 and buffers 24. Referring to FIG. 8, resistor-string DAC 22 includes n resistors 23A-1 . . . n connected in series between VH and conductor 19-1, n more string DAC resistors 23B-1 . . . n connected in series between conductors 19-1 and 19-2, n more string DAC resistors 23C-1 . . . n connected in series between conductors 19-2 and 19-3, and so forth. (The number q of columns of the LCD array is equal to n(m+1)). The various junctions, i.e., circuit nodes, between the foregoing series-connected resistors 23 are each coupled by transistors 60A-1,2 . . . n, 60B-1,2 . . . n, and so forth via conductor 61 to the input of an RDAC (resistor DAC) buffer amplifier circuit 62, the output of which is connected to an input of a q-channel multiplexer 64.

Referring again to FIG. 7, the gates of transistors 60A-1,2 . . . n, 60B-1,2 . . . n, and so forth are coupled to corresponding outputs of switch control logic 65 of source driver switch circuitry 18. The outputs of multiplexer 64 are connected to the inputs of q corresponding column driver buffers 66, respectively, the outputs of which are connected to column conductors 20-1, 2 . . . q, respectively, in order to multiplex the various gray scale voltages to the appropriate column conductors 20-1,2 . . . q, respectively, of LCD display 11. It ordinarily would be impractical to obtain an adequately large number (e.g., 4096) of column gamma correction voltages without using resistor-string DAC 22, because without it a separate DAC and buffer channel are required for each column, respectively, of LCD display 11. Using the various intermediate circuit nodes of resistor-string DAC 22 provides a piecewise approximation of the internal gamma correction voltages between the adjacent DAC/buffer channel outputs.

Register 42-1, 2 . . . m can be programmed by the LOAD signal on conductor 56 of FIG. 7 to immediately and directly pass the contents of register 46-1, 2 . . . m to the appropriate inputs of DACs 28-1, 2 . . . m. The data on the inputs of register 42-1, 2 . . . m can be entered into register 42 either in response to an enable signal EN on conductor 55 applied to one input of OR gate 50 or in response to a software-produced signal LOAD on conductor 56 which is applied by I2C control interface logic 48 to the other input of OR gate 50. In this manner, register 42-1, 2 . . . m is updated with the gray scale codes pre-loaded into register 46 by I2C controller interface logic 48. A rising edge of each of the clock signals on the various conductors of bus 53 updates the flip-flops in the corresponding selected register section(s) 46-1,2 . . . m with the gray scale codes provided on bus 52 by I2C controller interface logic 48.

A "1" applied to the clock inputs of latches 42-1,2 . . . m allows data present at the inputs of latches 42-1,2 . . . m to propagate to the outputs thereof, thereby causing latches 42-1, 2 . . . m each to be "transparent". A "0" applied to the clock inputs of latches 42-1,2 . . . m causes them to hold, i.e., maintain, their previous stored logic states and thereby prevents present input data from being loaded into latches 42-1,2 . . . m.

The EN signal on conductor 55 in FIG. 7 is utilized to allow the user to provide hardware control of the function of clocking the digital gray scale codes into latches 42-1,2 . . . m and hence to the inputs of DACs 21-1,2 . . . m, respectively. If EN is at a "1" level, then if a gray scale code is written into any of registers 46-1,2 . . . m, that gray scale code then is "transparently" passed through the latches of the corresponding one of registers 42-1,2 . . . m to update the inputs of the corresponding one of DACs 28-1,2 . . . m.

The above described structure therefore allows I2C controller interface logic 48 to write gray scale codes into any desired register section(s) 46-1,2 . . . m by simply clocking the gray scale code on bus 52 into the desired register section(s) 46-1,2 . . . m by means of a clock signal on the corresponding one(s) of clock conductors 53. Thus, DACs 28-1, 2 . . . m can be updated in whatever order desired. (Alternatively, each group of 10 flip-flops or latches could have its own address decoder in which case the same address lines would go to each of the 12 groups of 10 flip-flops/latches.)

There are three methods, referred to herein as Method 1, Method 2, and Method 3, for transferring digital input words from register 46-1, 2 . . . m to register 42-1,2 . . . m and hence to the corresponding inputs of DACs 28-1, 2 . . . m.

In Method 1, EN on conductor 55 is externally set to a "1", which produces a "1" on conductor 54. Therefore, the latches 42-1, 2 . . . m are transparent, as explained earlier. Consequently, each DAC output voltage is immediately updated whenever its corresponding register section 46-1, 2 . . . m is updated.

In Method 2, the signal LOAD on conductor 56 is kept at a "0" level. The signal EN on conductor 55 is externally set to "0" to cause latches 42-1, 2 . . . m to continue to store their previous logic states, and thereby cause all of the DAC output voltages to hold their present values during transfer of gray scale data by I2C controller interface logic 48 into flip-flops 46-1, 2 . . . m, after which EN can be set to a "1" level by a conventional timing controller or other controller, for example. Setting EN on conductor 55 to the "1" level simultaneously updates the contents of latches 42-1, 2 . . . m, and thereby simultaneously updates output voltages of all of DACs 28-1,2 . . . m in accordance with the updated register values.

In the example of FIG. 7 wherein m=12, 10 bits are used for the gray scale codes. However, conventional I2C communications protocol requires 16 bits, i.e., two bytes for transmission of the 10 bits. So if one of the 16 software bits which is not a gray scale code data bit, e.g., bit 15, is set to a "1", then the software executed by I2C control interface logic 48 operates to 42-1, 2 . . . m make the latch associated with the one of register sections 46-1, 2 . . . m transparent in the sense that the data from the flip-flops of that register section immediately passes through the latch 42-1, 2 . . . m to the inputs of the corresponding DAC 28-1, 2 . . . m. This can be accomplished by software, without involving the EN signal on conductor 55. The software causes I2C control interface logic 48 to activate the LOAD signal on conductor 56 to thereby produce a "1" on conductor 54 and thereby cause latches 42-1, 2 . . . m to be transparent. Alternatively, and perhaps preferably, the latch circuitry can be easily designed to simply make the latch transparent if the input presented to bit 15 of a latch section is a "1".

With the foregoing information in mind, above mentioned Method 3 uses software control to cause I2C controller interface logic 48 to maintain the signal LOAD on conductor 56 at a "0" while updating gray scale codes in register 46-1,2 . . . m. Consequently, the outputs of DACs 28-1,2 . . . m are unchanged while I2C controller interface logic 48 updates register 46-1,2 . . . m. When I2C controller interface logic 48 writes a "1" in an unused software bit 15 corresponding to any of the 10-bit flip-flop register sections 46-1,2 . . . m, software executed by I2C controller interface logic 48 also sets the signal LOAD on conductor 56 to a "1" level. That "1" level is applied via OR gate 50 to the clock inputs of latches 42-1,2 . . . m, thereby causing them to become transparent. The update of the appropriate one(s) of DACs 28-1, 2 . . . m then automatically occurs as the corresponding one(s) of latches 42-1, 2 . . . m receive(s) the 10-bit data in the two-byte I2C protocol from register 46-1, 2 . . . m.

Methods 2 and 3 can be used to transfer a future set of gray scale codes into registers 46-1,2 . . . m in advance to prepare for a fast update of the output voltages of DACs 28-1,2 . . . m through latches 41-1, 2 . . . m.

The advantage to the user of the above described simultaneous updating is that it allows preloading the gray scale data in register 46-1, 2 . . . m, without causing the image on LCD display screen 11 to change. Then, when DACs 28-1,2 . . . m are simultaneously updated the resulting change in the screen image occurs very rapidly and is not very noticeable. That is, the annoying image "artifacts", such as a "shimmering" of the image, that result from a gradual updating of the gray scale codes across LCD screen 11 are of very short duration.

To perform the above-mentioned static gamma correction in LCD display system 10B of FIG. 5, the gamma correction voltages are adjusted until they produce a gamma curve that is satisfactory to an expert who, as previously explained, is skilled in visualizing and correcting displays on LCD screens. When the suitable gamma curve is achieved, data representative of the gamma selection curve, represented by the selected gamma correction voltages, is stored. While the effects on the images of the LCD display screen 11 are being observed by an expert, an I2C interface system is used to communicate with gamma reference voltage generator 35B as gamma correction voltages are being adjusted. Values selected as acceptable by the expert then are stored in a suitable non-volatile memory, such as EEPROM 26 or internal non-volatile memory 26. Usually, the generation of the static gamma curve is performed only once or twice during the life of an LCD display.

The above described dual register input structure 46,42 reduces "programming" time for generating and storing an acceptable static gamma correction codes by allowing updated DAC input values to be pre-stored into register 46. Storage of this data can occur while an image of a particular video frame is being displayed. As long as the data is stored only in register 46, the DAC output values remain unchanged and the current display image is unaffected.

During an appropriate interval of the picture frame, the DAC output voltages and hence the gamma correction voltages can be quickly updated either by using an additional control line connected to the LOAD input on conductor 56 or under software control, by writing a "1" in the above-mentioned unused bit of register 46. This significantly facilitates dynamic gamma correction control because it significantly reduces the time required to "update" the original static gamma curve stored in the non-volatile memory 26 or 26A. This is a substantial improvement over the prior art wherein the static gamma curves could not be dynamically updated fast enough, resulting in annoying "switching artifacts" observable on the LCD display screen.

Multiple static gamma curves can be stored in EEPROM 26 or other non-volatile memory 26A and used for the purpose of dynamically selecting the stored gamma curves in response to measurements of LCD display panel image conditions, the ambient temperature or panel temperature, and/or the external light intensity to improve the LCD display performance. Dynamic gamma correction involves making real-time adjustments to the initial gamma correction curve, wherein the brightness in each image frame is analyzed and the gamma curves are adjusted accordingly on a frame-by-frame basis. The gamma curves typically are dynamically updated during a suitable period of the video signal. This process is greatly facilitated by the above described dual register structure 46,42 and use of a fast I2C interface logic circuit 48. Simultaneous updating of all DACs is facilitated by the ability to update one or all channels via a software command.

Figure 6:
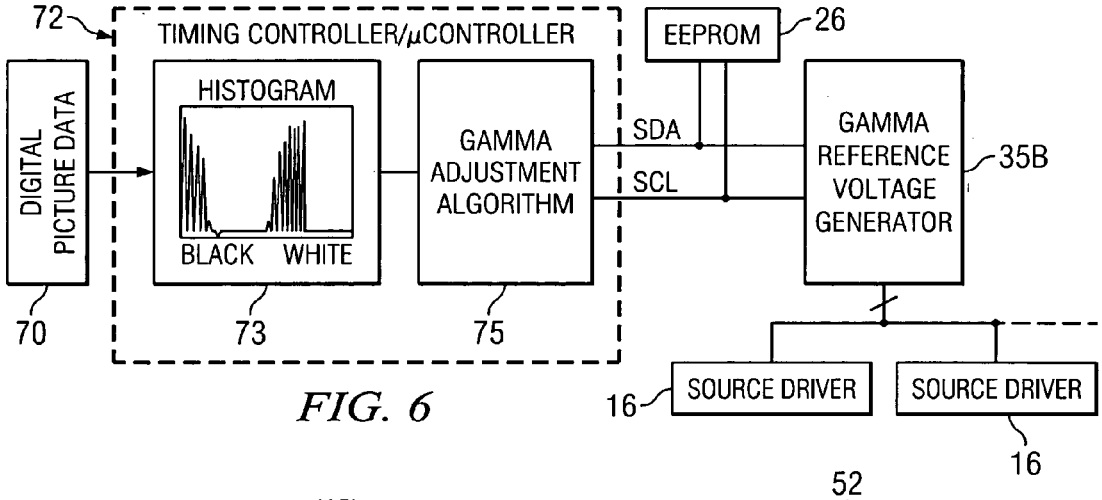
FIG. 6 is a block diagram of controller circuitry 32B of FIG. 5.

The basic timing for dynamic gamma correction is that during every image frame, e.g., every 60th of a second, the value of the gamma correction voltage is changed, i.e., the color curve is updated by a gamma adjustment algorithm executed, for example, by the timing controller 32A in FIG. 6. This changes the display characteristics of the image displayed on a real-time basis. For example, some dark areas of the displayed images may be made lighter to reveal better detail. During the active image frame interval, the values for updated gamma correction are loaded into the first register 46. At an appropriate time the gamma correction voltage values are loaded into the second register 42, and the output voltages of DACs 28 and corresponding output voltages of buffers 24 change accordingly. The image display can be instantly updated from the outputs of the flip-flops of second register 42.

As shown in FIG. 6, by using various gamma adjustment algorithms the digital image data 70 can be analyzed in a timing controller or DSP 72 to reveal a histogram 73 of the brightness for a whole image frame. A gamma adjustment algorithm 75 for evaluating the brightness histogram and running in the controller or DSP 72 determines how the gamma curve is modified to improve the appearance of the LCD image.

Another approach to dynamic gamma correction could also be performed by generating and storing multiple pre-selected gamma curves in internal memory 26A in FIG. 5 and selecting the appropriate one in response to an algorithm which dynamically determines which stored gamma curves to use.

Rather than laboriously optimizing the values of precision resistors to be used in a resistor-string voltage divider to produce the optimal gamma voltages as previously explained, a computer can be provided to control or perform the above-mentioned adjustment of the gamma voltages by varying the digital inputs to the DACs 28-1, 2 . . . m to produce the static color curve as a skilled expert views images on the LCD display and on this basis selects the DAC output voltages that result in the optimum LCD display image qualities. The resulting optimized data representing the static gamma correction inputs to the DACs for each buffer are stored in EEPROM 26 or non-volatile memory 26A and can be used for either static or dynamic gamma voltage correction. The next needed gamma correction voltage data can be loaded into register 46, and may be used later to instantaneously update the LCD screen display quality information at the right time. This is useful mainly for dynamic gamma control based on LCD image properties, but also can be useful to update gamma voltage correction according to temperature or ambient light conditions.

The above described gamma reference voltage generators of FIGS. 4 and 5 also can be used to reduce the development time for generation of static gamma curves and avoid the need for using the above described resistor-strings in FIG. 1 to program gamma correction buffers, by providing circuitry that includes separate programmable "DAC channels" for generating the static gamma curve and enabling the gamma correction voltages representing the static gamma curve to be set up quickly in response to software controlled by an expert or in response to software which might be developed to automatically generate the static gamma curve.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. Other circuitry could be used that can simultaneously shift the gray scale codes, once they have been loaded, to the inputs of DACs 28-1,2 . . . m. For example, the DAC registers 46 and 42 could be implemented using shift registers.

What is claimed is:

1. A gamma reference voltage generator for generating and applying gamma reference voltages to a source driver circuit of an LCD display system in response to gray scale codes received from a controller, comprising:

a control interface logic circuit having an output bus;

a first register including a plurality of groups of storage cells, the storage cells of each group having an input coupled to corresponding conductors of the output bus of the control interface logic circuit;

a plurality of DACs each having an input coupled to an output of a corresponding storage cell of the second register;

a plurality of buffers each having an input coupled to an out of a corresponding DAC and an output coupled to a resistor-string DAC of the source driver circuit and to source driver switch circuitry of the source driver circuit;

the control interface logic circuit being operative to:

receive gray scale codes representative of gamma reference voltages to be applied to source drivers of the source driver circuit and transfer the gray scale codes via the output bus to corresponding storage cells of the first register, and cause the gray scale codes in the first register to be applied to inputs of the DACs to produce signals representative of the gamma correction voltages to be applied to the source driver circuit.

2. The gamma reference voltage generator of claim 1 including a second register including a plurality of storage cells each having an input coupled to an output of a corresponding cell of the first register, the control interface logic circuit causing the gray scale codes in the first register, to be applied to the inputs of the DACs by entering the gray scale codes in the first register into the second register.

3. The gamma reference voltage generator of claim 2 including a resistor-string DAC that includes a plurality of resistors coupled in series between first and second reference voltages, a plurality of switches being coupled between various junctions between the resistors and an input of a multiplexer, outputs of the multiplexer being coupled to column driver buffers of the source driver circuit, various groups of the resistors being coupled between outputs of various pairs of the buffers, respectively.

4. The gamma reference voltage generator of claim 3 including switch control logic coupled to control the switches to sequentially couple gamma correction voltages from various nodes of the resistor-string DAC, respectively, to the input of the multiplexer in response to a control signal from the controller.

5. The gamma reference voltage generator of claim 3 wherein the plurality of buffers overpower junctions of the resistor-string DAC which are connected to the outputs of the buffers.

6. The gamma reference voltage generator of claim 2 including a serial bus for coupling gray scale codes from the controller to the control interface logic circuit.

7. The gamma reference voltage generator of claim 2 wherein the storage cells of the first register include flip-flops and the storage cells of the second register include latches.

8. The gamma reference voltage generator of claim 7 including a logic gate having a first input coupled to receive a first control signal and a second input coupled to receive a second control signal from the control interface logic circuit for producing a logical ORing of the first and second control signals to produce a clock signal applied to clock inputs of the latches.

9. The gamma reference voltage generator of claim 8 wherein the latches are transparent to outputs of the flip-flops if the clock signal is at a "1" level and wherein the latches hold logic states therein if the clock signal is at a "0" level.

10. The gamma reference voltage generator of claim 9 wherein the first control signal is set to a "1" level causing the latches to be transparent thereby causing inputs to the DACs to be immediately updated with gray scale codes as they are loaded into the flip-flops by the control interface logic circuit.

11. The gamma reference voltage generator of claim 9 wherein the first and second control signals are at a "0" level to cause the latches and the DACs to operate to maintain previous gamma reference voltages during transfer of gray scale codes by the control interface logic circuit into the flip-flops and the first control signal then goes to a "1" level to simultaneously update the contents of the latches and thereby simultaneously update output voltages of the DACs.

12. The gamma reference voltage generator of claim 9 wherein the control interface logic circuit is operative to maintain the second control signal at a "1" level while updating gray scale codes in the flip-flops to maintain the outputs of the DACS unchanged while control interface circuit updates the flip-flops and then sets the second control signal to a "0" level to set the latches to a transparent condition to cause the DACs to be simultaneously updated.

13. A method of generating gamma reference voltages and applying them to a source driver circuit of an LCD display system in response to gray scale codes sequentially supplied by a controller, comprising:

sequentially loading a plurality of gray scale codes into a plurality of groups of storage cells, respectively, of a first register;

transferring the plurality of gray scale codes from the groups of storage cells of the first register into a plurality of groups of storage cells, respectively, of a second register;

transferring the plurality of gray scale codes from the plurality of groups of storage cells of a second register to inputs of a plurality of DACs; and coupling outputs of the DACs to a first group of circuit nodes of a resistor-string DAC to dynamically update outputs of the resistor-string DAC and coupling a second group of circuit nodes of the resistor-string DAC to inputs of a source driver circuit.

14. The method of claim 13 wherein the second group of circuit nodes includes the first group of circuit nodes.

15. The method of claim 13 wherein the resistor-string DAC includes a plurality of resistors coupled in series between first and second reference voltages, the method including multiplexing voltages of various circuit nodes of the second group to inputs of column driver buffers of the LCD display system.

16. The method of claim 13 including setting the first control signal to a "1" level to cause the latches to be transparent thereby causing inputs to the DACs to be immediately updated with gray scale codes as they are loaded into the flip-flops by the control interface logic circuit.

17. The method of claim 13 including setting the first and second control signals to "0" levels to cause the latches and the DACs to operate to maintain previous gamma reference voltages during transfer of gray scale codes by the control interface logic circuit into the flip-flops and setting the first control signal to a "1" level to simultaneously update the contents of the latches and thereby simultaneously update output voltages of the DACs, to thereby avoid image artifacts associated with sequential updating of columns of an image being displayed by the LCD display system.

18. The method of claim 13 including operating the control interface logic circuit to maintain the second control signal at a "1" level while updating gray scale codes in the flip-flops to maintain the outputs of the DACs unchanged while updating the flip-flops and then set the second control signal to a "0" level to set the latches to a transparent condition to cause the DACs to be simultaneously updated with the gray scale codes updated in the flip-flops, to thereby avoid image artifacts associated with sequential updating of columns of an image being displayed by the LCD display system.

19. The method of claim 13 wherein step (a) includes the loading of various gray scale codes in response to observation of visual effects of various gray scale codes on one or more images displayed by the LCD display system to obtain an optimized color curve for the LCD display system, and storing gray scale codes representing the optimized color curve in a non-volatile memory accessible by the controller.

20. A system for generating gamma reference voltages and applying them to a source driver circuit of an LCD display system in response to gray scale codes sequentially supplied by a controller, comprising:

means for sequentially loading a plurality of gray scale codes into a plurality of groups of storage cells, respectively, of a first register;

means for transferring the plurality of gray scale codes from the groups of storage cells of the first register into a plurality of groups of storage cells, respectively, of a second register;

means for transferring the plurality of gray scale codes from the plurality of groups of storage cells of a second register to inputs of a plurality of DACs; and means for coupling outputs of the DACs to a first group of circuit nodes of a resistor-string DAC to dynamically update outputs of the resistor-string DAC and coupling a second group of circuit nodes of the resistor-string DAC to inputs of a source driver circuit.

* * * * *